US008801409B2

(12) United States Patent
Lilie et al.

(10) Patent No.: US 8,801,409 B2
(45) Date of Patent: Aug. 12, 2014

(54) PISTON FOR A REFRIGERATION COMPRESSOR

(75) Inventors: Dietmar Erich Bernhard Lilie, Joinville (BR); Ingwald Vollrath, Joinville-SC (BR)

(73) Assignee: Whirlpool S.A., São Paulo-Sp (BR)

( * ) Notice: Subject to any disclaimer, the term of this patent is extended or adjusted under 35 U.S.C. 154(b) by 378 days.

(21) Appl. No.: 12/664,914

(22) PCT Filed: Jul. 3, 2008

(86) PCT No.: PCT/BR2008/000192

§ 371 (c)(1),
(2), (4) Date: Mar. 5, 2010

(87) PCT Pub. No.: WO2009/003260

PCT Pub. Date: Jan. 8, 2009

(65) Prior Publication Data

US 2010/0183463 A1 Jul. 22, 2010

(30) Foreign Application Priority Data

Jul. 4, 2007 (BR) ..... 0702471

(51) Int. Cl.
*F04B 53/12* (2006.01)

(52) U.S. Cl.
USPC ..... 417/553

(58) Field of Classification Search
USPC ..... 417/545, 550, 553; 92/181 R, 181 P, 92/208, 231; 91/422
See application file for complete search history.

(56) References Cited

U.S. PATENT DOCUMENTS

| | | | | |
|---|---|---|---|---|
| 1,711,253 | A | 4/1929 | Spreen | |
| 1,817,853 | A * | 8/1931 | Small | 417/511 |
| 2,026,611 | A * | 1/1936 | Chase | 92/224 |
| 2,430,401 | A | 11/1947 | Hunt et al. | |
| 2,522,633 | A | 9/1950 | Phillips | |
| 2,926,975 | A * | 3/1960 | Karde et al. | 92/157 |
| 4,016,960 | A * | 4/1977 | Wilcox | 188/282.5 |
| 4,377,967 | A * | 3/1983 | Pelizzoni | 92/186 |
| 5,174,735 | A * | 12/1992 | Gannaway | 417/550 |
| 5,947,708 | A * | 9/1999 | Park et al. | 417/552 |
| 6,209,510 | B1 * | 4/2001 | Brogdon et al. | 123/197.4 |
| 6,381,842 | B2 * | 5/2002 | Kato et al. | 29/888.044 |
| 6,395,404 | B1 * | 5/2002 | Kato et al. | 428/582 |
| 6,415,705 | B1 * | 7/2002 | Kato et al. | 92/71 |
| 6,616,426 | B1 * | 9/2003 | Liang et al. | 417/545 |
| 6,634,867 | B2 * | 10/2003 | Pressel | 417/269 |
| 6,648,612 | B2 * | 11/2003 | Hsiao | 417/313 |
| 6,813,990 | B2 * | 11/2004 | Shiina | 92/71 |

(Continued)

FOREIGN PATENT DOCUMENTS

| | | |
|---|---|---|
| GB | 379118 A | 8/1932 |
| GB | 485424 A | 5/1938 |

*Primary Examiner* — Devon Kramer
*Assistant Examiner* — Charles W Nichols
(74) *Attorney, Agent, or Firm* — Gifford, Krass, Sprinkle, Anderson & Citkowski, P.C.

(57) ABSTRACT

A piston of the type comprising a tubular skirt portion which is closed, next to an end edge, by a head portion, the skirt portion being defined by a respective tube extension and presenting an end edge region configured to affix a head portion formed in a separate piece and having a peripheral contour internal to an axial projection of the outer contour of the skirt portion.

9 Claims, 11 Drawing Sheets

(56) References Cited

U.S. PATENT DOCUMENTS

| | | | | |
|---|---|---|---|---|
| 7,607,900 | B2 * | 10/2009 | Ichikawa et al. | 417/540 |
| 2002/0018725 | A1 * | 2/2002 | Ota et al. | 417/269 |
| 2003/0017067 | A1 * | 1/2003 | Chou | 417/553 |
| 2003/0047216 | A1 * | 3/2003 | Kelly | 137/538 |
| 2004/0071574 | A1 | 4/2004 | Bez et al. | |
| 2004/0188197 | A1 * | 9/2004 | Lisenker | 188/267.2 |
| 2006/0250031 | A1 * | 11/2006 | Kim | 310/13 |
| 2008/0314240 | A1 * | 12/2008 | Walker et al. | 92/186 |

* cited by examiner

PISTON FOR A REFRIGERATION COMPRESSOR

CROSS-REFERENCE TO RELATED APPLICATIONS

This application is the US National Phase Application under 35 USC. §371 of International Patent Application No. PCT/BR2008/00092 filed Jul. 3, 2008, which claims priority to and the benefit of Brazilian Patent Application No. PI07024714, filed Jul. 4, 2007, each of which are hereby incorporated by reference in their entireties. The International Application was published as WO 2009/003260 A1 in the English language on Jan. 8, 2009.

FIELD OF THE INVENTION

The present invention refers to a piston of the type used in refrigeration compressors of refrigeration systems, particularly a long piston of the type presenting a head portion from which projects a tubular skirt portion, occupying part of the extension of a compression chamber in a cylinder of a cylinder block of the compressor.

BACKGROUND OF THE INVENTION

In a reciprocating compressor driven by a linear motor, the gas suction and gas compression operations are carried out with the reciprocating axial movements of the piston in the interior of a cylinder closed by a head and, in some constructions, mounted in the interior of a hermetic shell of the compressor. The piston is driven by a motor unit of the compressor.

Pistons for a refrigeration compressor generally present a monolithic construction, defining, in a single piece, the formation of a head portion and a skirt portion, said piston construction being obtained, for example, by machining a metallic blank, usually made of steel. This manufacturing process is expensive and presents a high material waste.

There are also known other processes for obtaining pistons in a single piece for refrigeration compressors, such as cold shaping, stamping, etc. However, said processes, besides having a still high cost, present pieces with a high degree of dimensional uncertainty, which affects the actuation of the piston in the compressor.

These disadvantages are still greater in the constructions in which the suction is provided through the piston body.

Besides the above disadvantages, the monolithic constructions for the piston of a refrigeration compressor do not result in pistons presenting low material and production costs, low weight, good resistance, low porosity, low friction coefficient, etc., which characteristics are mainly relevant in long pistons and, more particularly, in pistons which operate in a compressor without oil lubrication or also in a gas bearing compressor.

OBJECT OF THE INVENTION

Thus, it is an object of the present invention to provide a piston for a refrigeration compressor which can be easily obtained, with a reduced cost and without presenting material waste during the manufacturing process.

Another object of the present invention is to provide a piston such as cited above and which allows the construction of long pistons from different materials and by different manufacturing processes for its formation, said materials being defined as a function of the needs of each specific part of the piston during its operation in the compressor.

A further object is to provide a piston which easily and reliably provides the suction through the body of said piston.

SUMMARY OF THE INVENTION

These and other objects are attained through a piston for a refrigeration compressor of the type comprising a tubular skirt portion which is closed, next to an end edge, by a head portion, the skirt portion being defined by a respective tube extension and presenting an end edge region configured to affix a head portion formed in a separate piece and having a peripheral contour internal to an axial projection of the outer contour of the skirt portion.

BRIEF DESCRIPTION OF THE DRAWINGS

The invention will be described below, with reference to the enclosed drawings, in which.

DESCRIPTIONS OF THE ILLUSTRATED CONSTRUCTIONS

Figure 1:
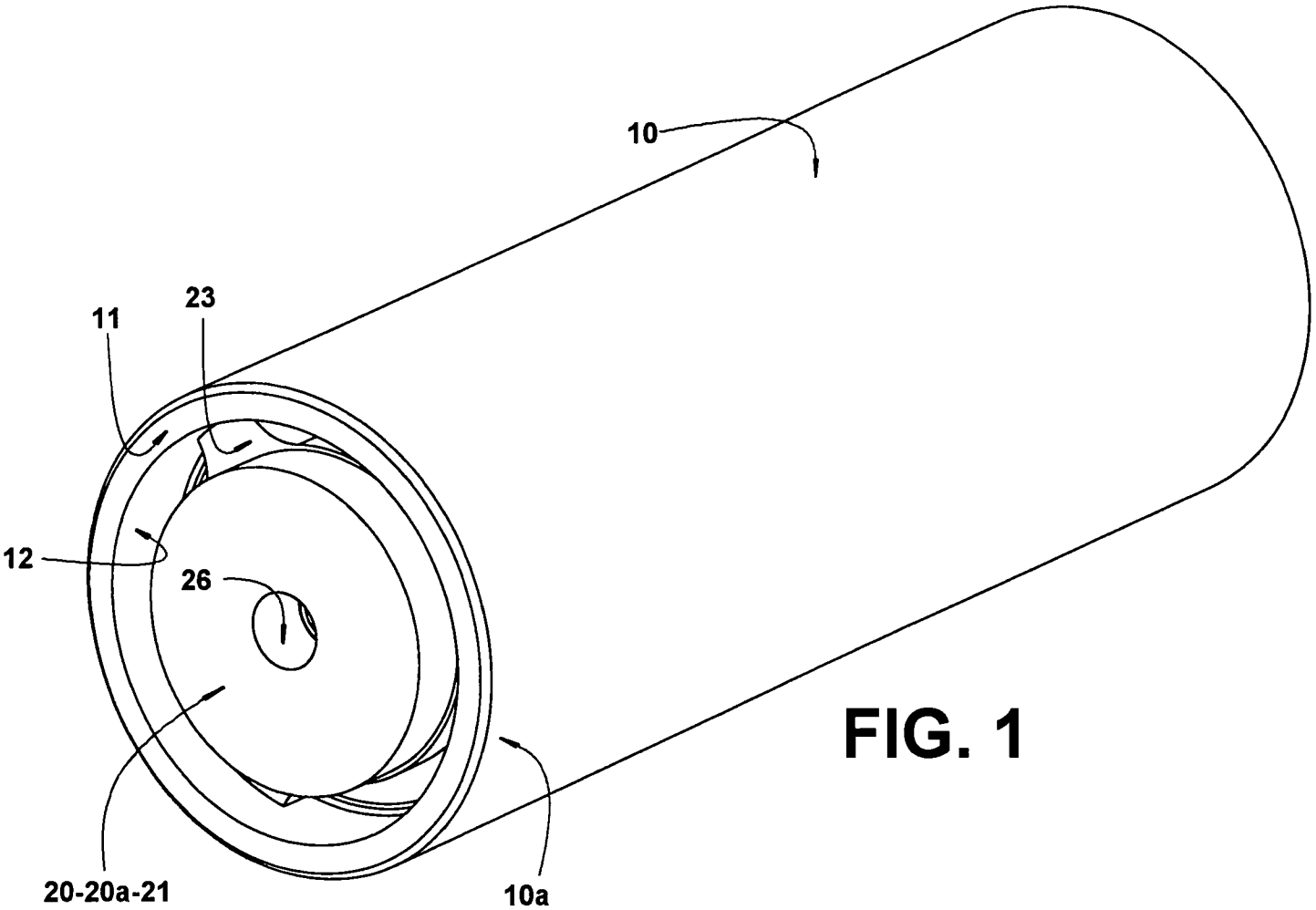
FIG. 1 represents, schematically and in perspective, a first piston construction for a refrigeration compressor which presents, in separate pieces, a head portion mounted in a tubular skirt portion and constructed to receive a suction valve, said piston being obtained according to the present invention.
Figure 2:
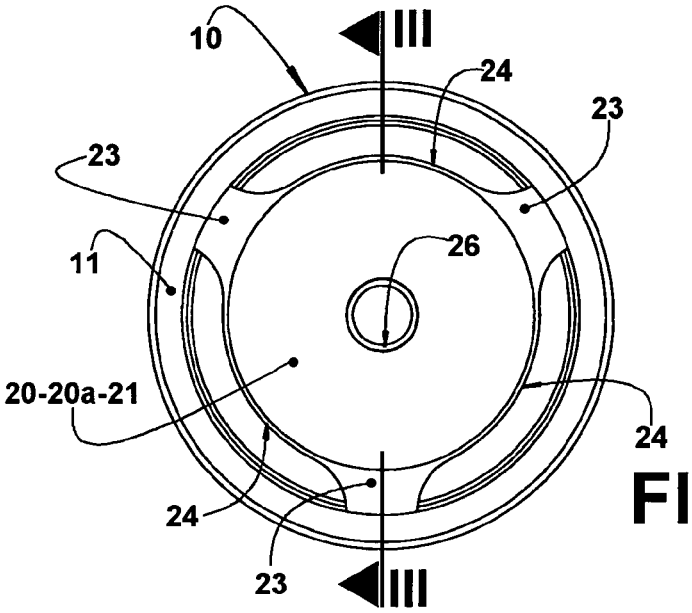
FIG. 2 schematically represents a top plan view of the piston construction illustrated in FIG. 1.
Figure 3:
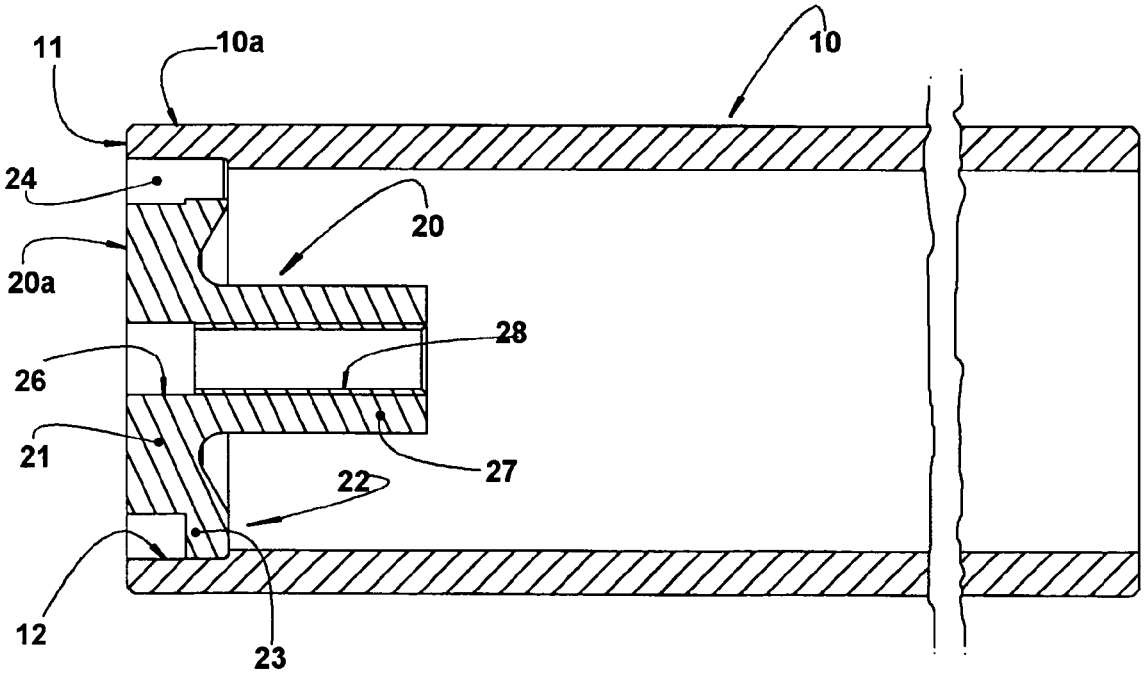
FIG. 3 schematically represents a sectional view of the piston illustrated in FIGS. 1 and 2, said view being taken according to line in FIG. 2.
Figure 4A:
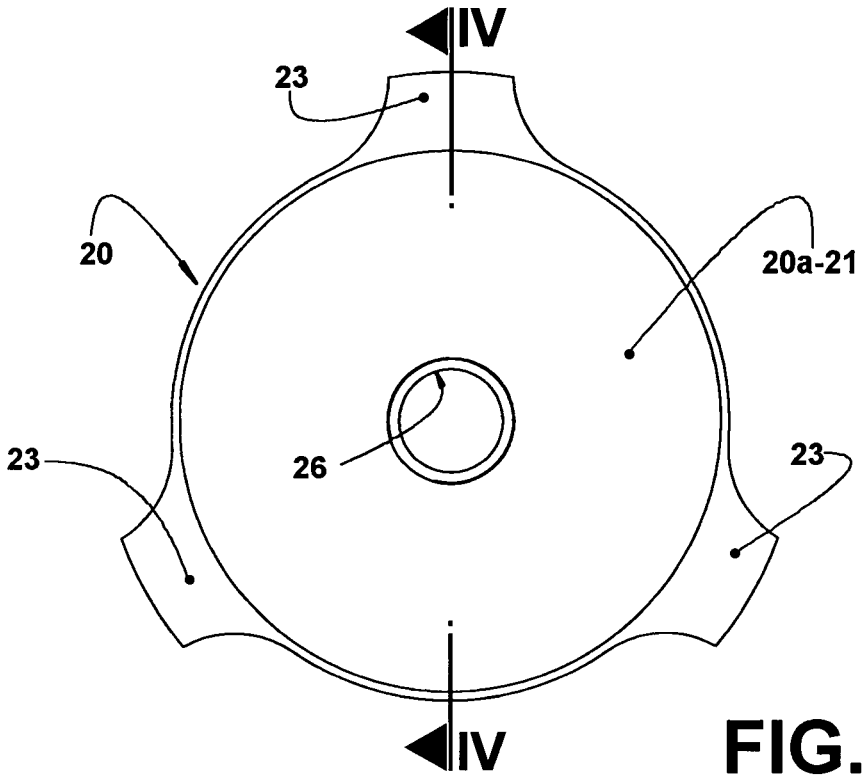
FIG. 4A represents a top plan view of the head portion of the piston of FIGS. 1-3.
Figure 4B:
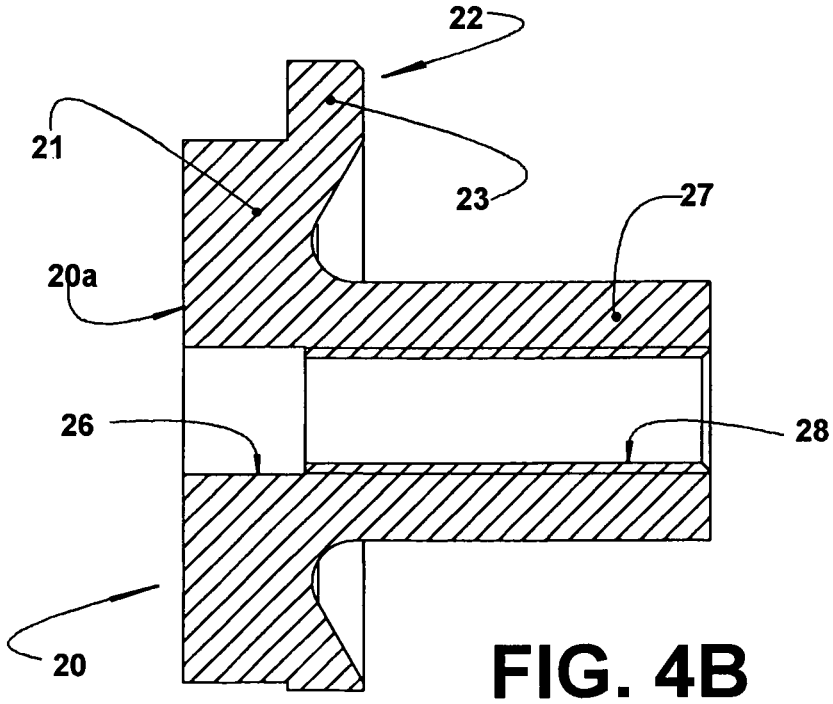
FIG. 4B schematically represents a longitudinal diametral sectional view, as in FIG. 3, of the head portion of the piston of the present invention, said view being taken according to line IV-IV in FIG. 4A.
Figure 5:
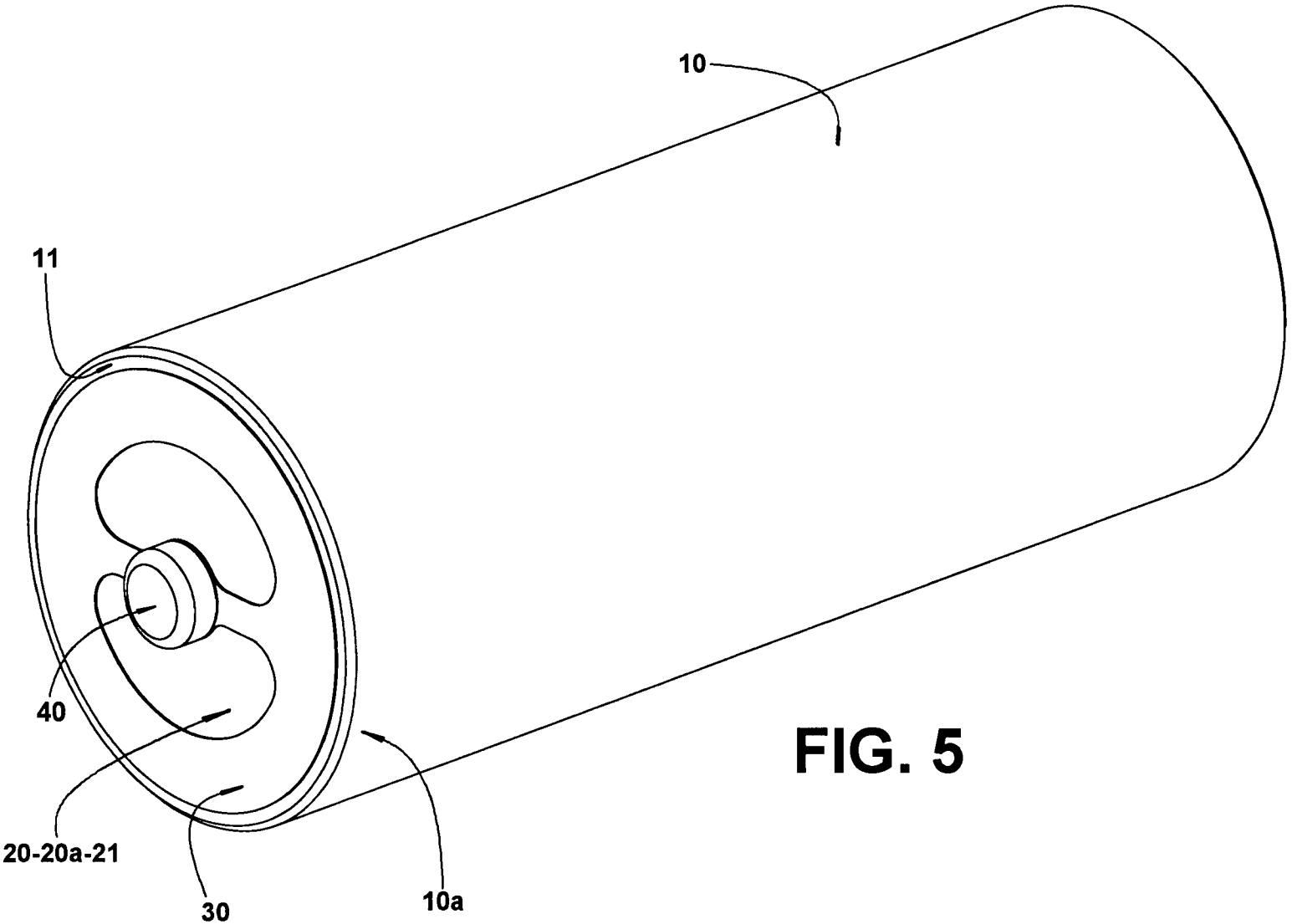
FIG. 5 represents a simplified view of the piston construction illustrated in FIG. 1, but having a suction valve mounted in the piston head portion.
Figure 6:
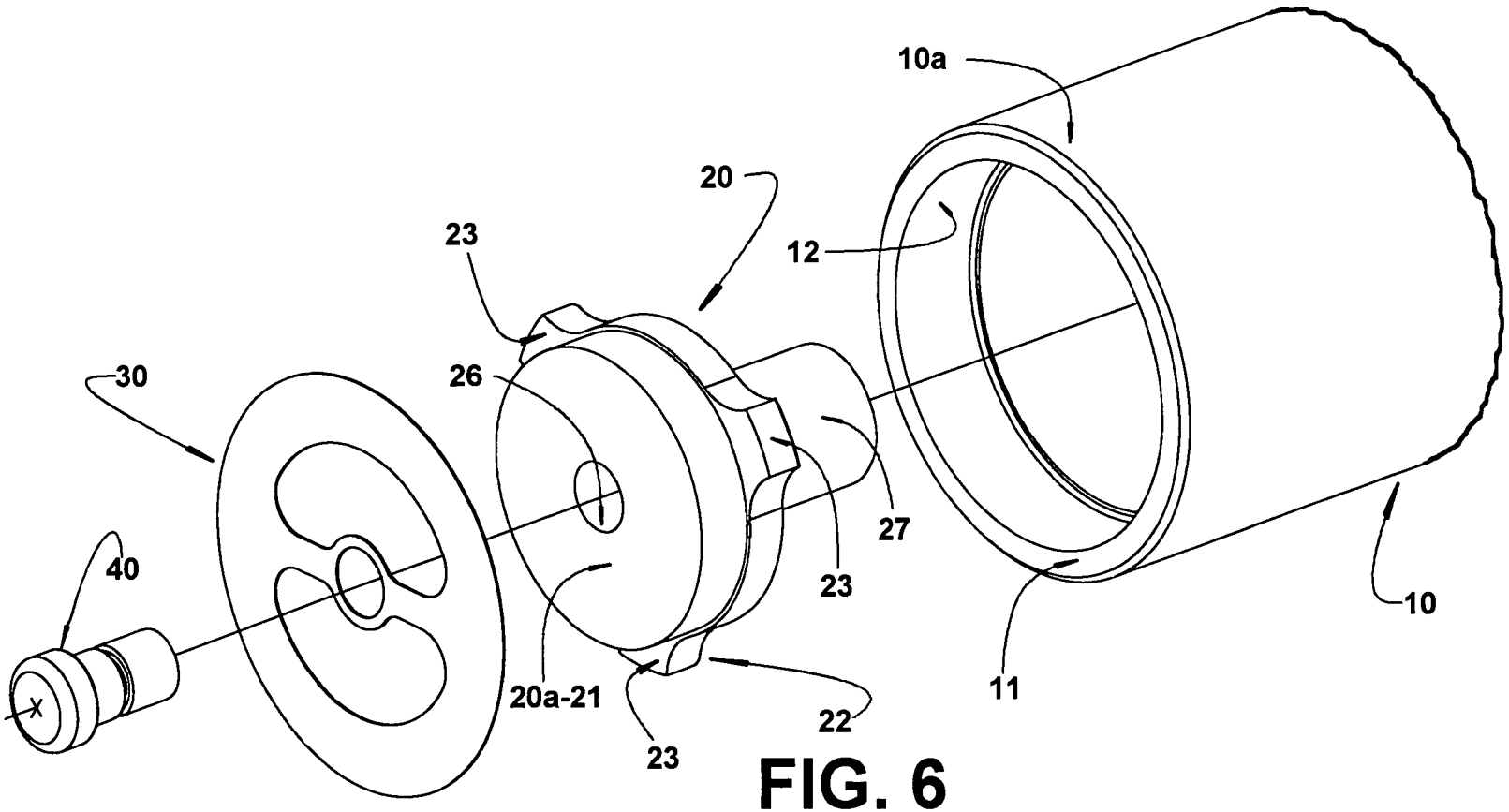
FIG. 6 schematically represents an exploded and partially sectioned view of a piston construction illustrated in FIG. 5.
Figure 7:
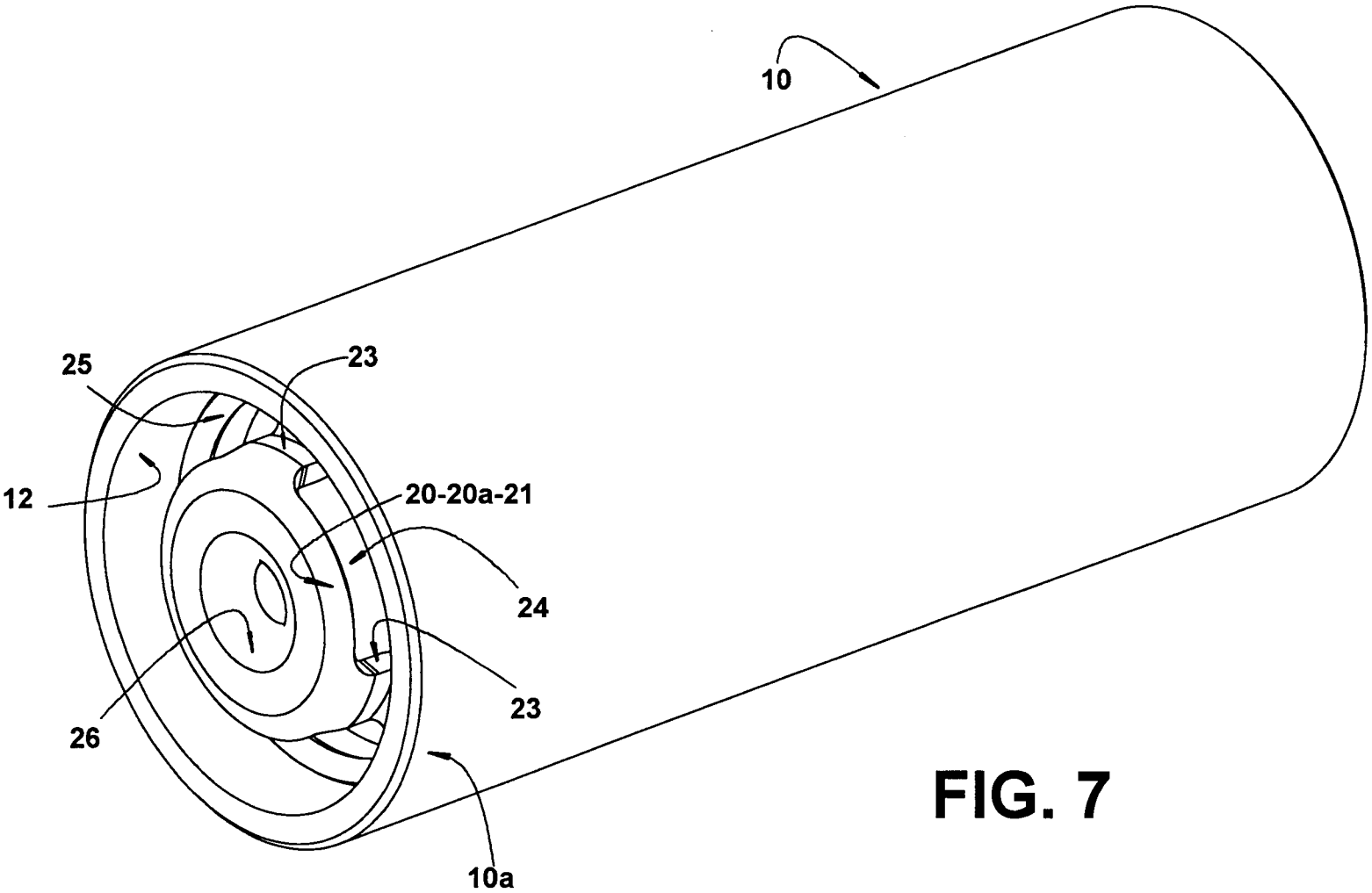
FIG. 7 schematically represents a view such as that of FIG. 1, of a second piston construction of the present invention.
Figure 8:
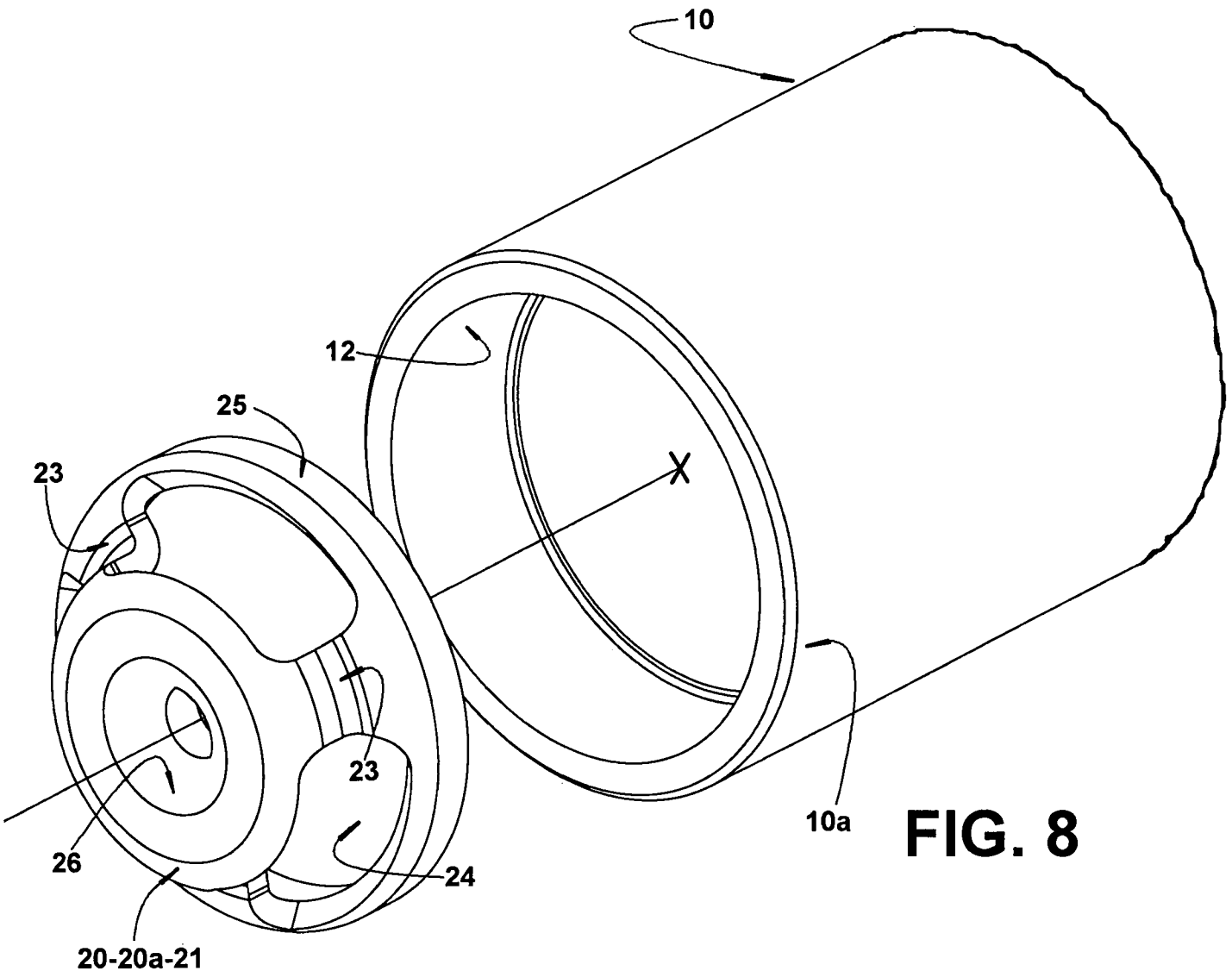
FIG. 8 schematically represents a view such as that of FIG. 7, but with the head portion in a position axially spaced from the skirt portion and constructed to receive a suction valve.
Figure 9:
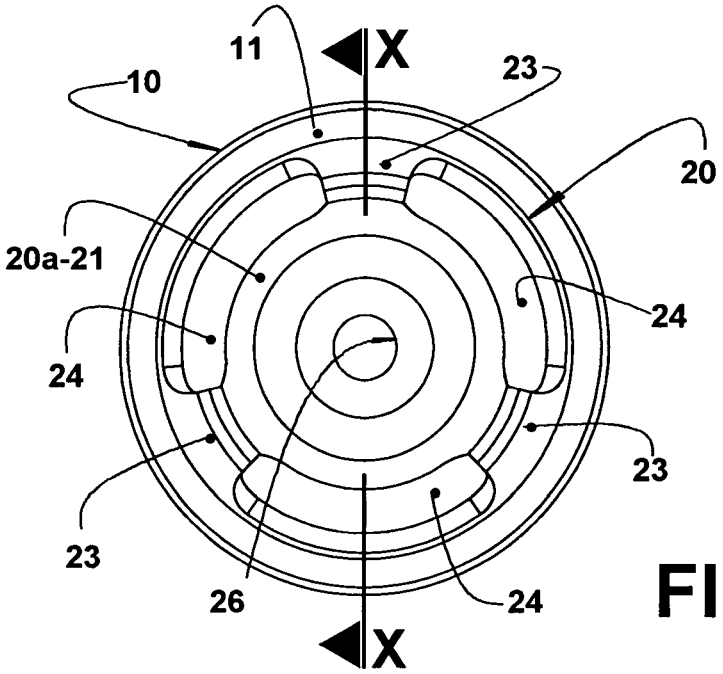
FIG. 9 schematically represents a top plan view of the piston illustrated in FIGS. 7 and 8.
Figure 10:
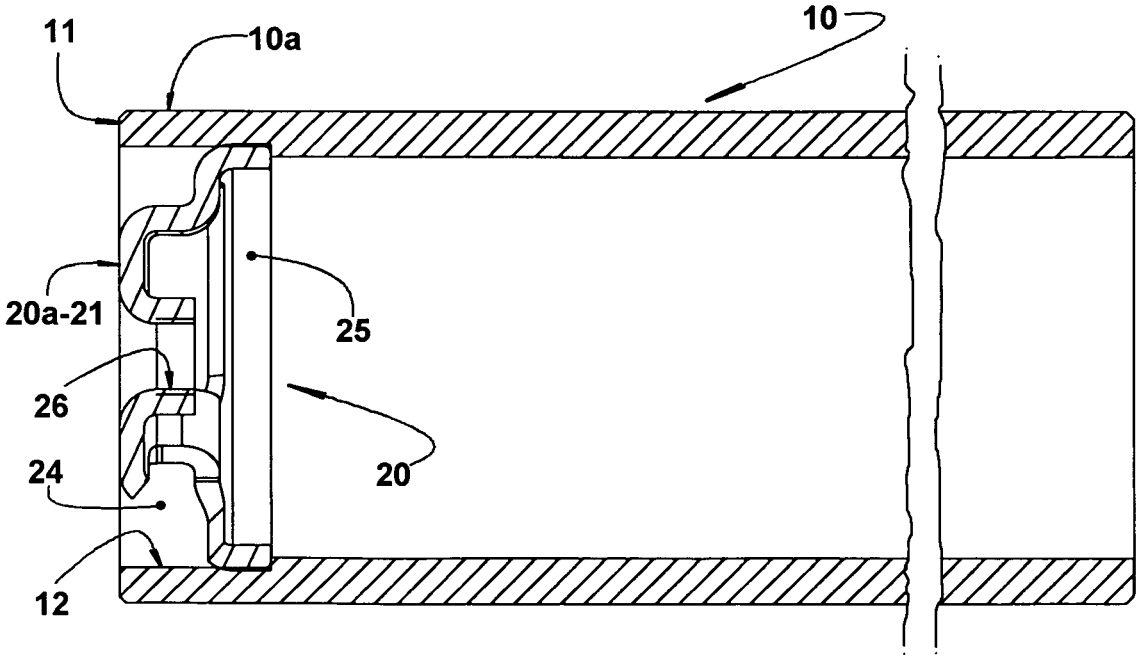
FIG. 10 schematically represents a sectional view of the second piston construction illustrated in FIGS. 7-9, said view being taken according to line X-X in FIG. 9.
Figure 11:
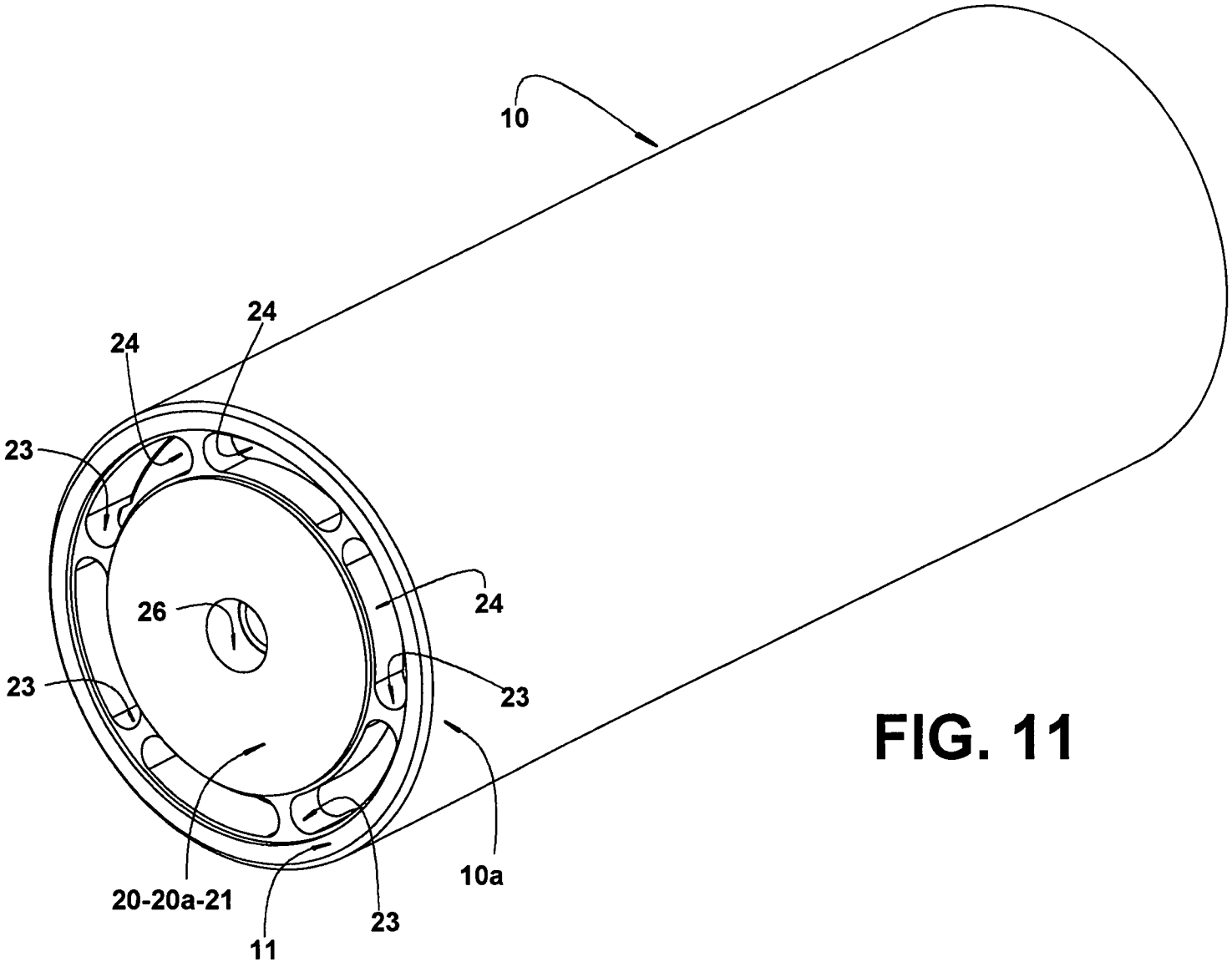
FIGS. 11, 12 and 13 represent, schematically and respectively, views such as those of FIGS. 1, 2 and 3, of a third piston construction of the present invention, said view, illustrated in FIG. 13, being taken according to line XIII-XIII in FIG. 12.
Figure 12:
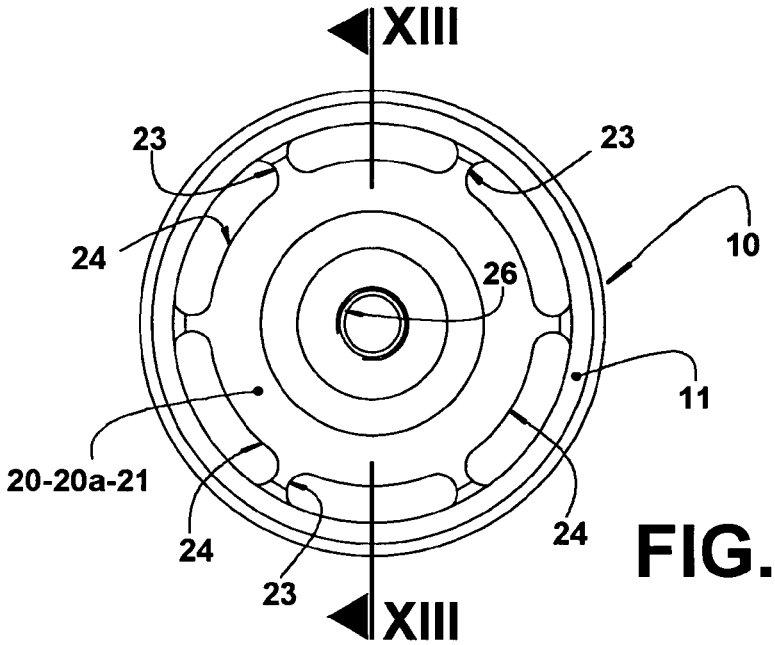
Figure 13:
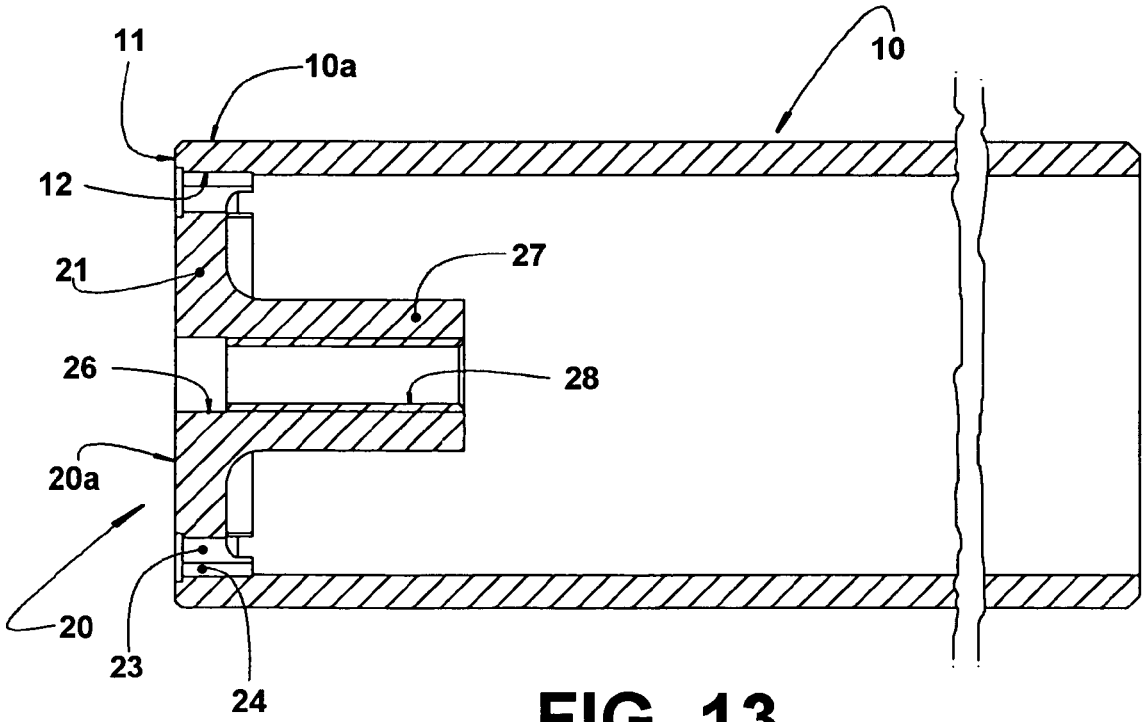

The present invention will be described for a piston of the type used for pumping refrigerant gas in a refrigeration compressor, when driven by a motor unit of the compressor.

Refrigeration compressors usually comprise a cylinder having an end closed by a valve plate (neither illustrated) and defining, with the cylinder, a compression chamber. The cylinder further presents an opposite end, through which is mounted the piston that reciprocates in the interior of the cylinder during the refrigerant fluid suction and compression cycles upon operation of the compressor, said movement being obtained by actuation of a motor unit (not illustrated), operatively coupled to said piston.

In some compressor constructions, such as some of those illustrated herein and described below, the suction of the refrigerant fluid occurs through the piston, in which is usually mounted a suction valve. For these constructions in which the suction occurs through the piston, a head portion thereof, described ahead, presents suction openings, which are selectively closed by a suction valve carried by the head portion of the piston.

In conventional constructions, with or without suction through the piston, the latter is obtained in a single piece and presents a head portion having a front face turned to the valve plate and from which projects, in opposition to said front face of said head portion, a tubular skirt portion, whose length is calculated as a function of the balance between the piston in the interior of the cylinder and the sealing, along the inner wall thereof, against compressed gas leakage during the compression cycle of the compressor operation. These constructions present the disadvantages already cited.

The present invention provides a piston construction comprising a tubular skirt portion 10 which is closed, next to an end edge 11, by a head portion 20 formed in a separate piece from the skirt portion 10, said parts of skirt portion 10 and head portion 20 being affixed to each other by an appropriate fixation means, such as glue, welding, mechanical interference, etc.

The skirt portion 10 is defined by a respective steel tube extension, preferably with outer surface hardening treatment, and presents an end edge region 10*a*, including the end edge 11, configured to affix a respective head portion 20 having a peripheral contour internal to an axial projection of the outer contour of the skirt portion 10.

The head portion 20 of the piston in description presents a front face 20*a*, coplanar to a plane containing the end edge of the skirt portion 10 and which actuates in the refrigerant fluid suction and compression cycles during the compressor operation.

In the constructions illustrated in FIGS. 1-13, in which the suction is provided through the piston, the front face 20*a* of the head portion 20 carries a suction valve 30, as described ahead.

Since the parts of skirt portion 10 and head portion 20 are separate from each other, each of said parts can be obtained through a specific process and with, a material more appropriate to the function to be carried out by each of these parts. It should be further understood that the present solution also provides the possibility of using the same manufacturing process of said parts which form the piston of the present invention, as well as the same material to obtain both parts of skirt portion 10 and head portion 20, these characteristics not being limitative of the present solution.

In accordance with a construction of the present invention, the skirt portion 10 internally presents, in said end edge region 10*a*, at least one recess 12 open to the end edge 11 of said skirt portion 10 and in which is mounted and affixed a peripheral edge of the head portion 20. The recess 12 is provided to occupy a certain circumferential extension of the inner contour of the skirt portion 10, defining a respective step, in relation to said inner contour, axially spaced back in relation to the end edge 11 of the skirt portion 10.

According to the illustrations, the skirt portion 10 of each piston construction, with or without suction, is preferably provided with a recess 12 of the above-described type. However it should be understood that the fixation of the head portion 20 in the skirt portion 10 can be made with no need of providing the recess 12.

In a construction of the present invention, the end edge region 10*a* of the skirt portion 10 is provided with a single continuous recess 12 occupying at least part of the inner circumferential contour of the skirt portion 10. In the constructions illustrated in the enclosed drawings, a single recess 12 occupies the whole inner circumferential contour of the end edge region 10*a* of the skirt portion 10. In the constructions of the present invention, in which the suction is made through the piston, the head portion 20 presents a base body 21 in which is defined the front face 20*a* of said head portion 20, and a mounting portion 22, incorporated to the base body 21 and through which the head portion 20 is mounted to the skirt portion 10. It should be understood that the mounting portion 22 can be incorporated to the base body 21 by fixation through adequate means, such as welding, or also incorporated, in a single piece, to said base body 21. The head portion 20 is usually affixed to the skirt portion 10 through the mounting portion 22. In the illustrated constructions, the mounting portion 22 is seated on and affixed to the recess 12 of the skirt portion 10. However, it should be understood that the mounting portion 22 can be seated and affixed against an inner surface portion of the skirt portion 10, in the end edge region 10*a* thereof, in constructions other than those illustrated herein, without, for example, requiring the provision of recesses in said inner surface of the skirt portion 10.

It should be understood that whatever the fixation means used between the head portion 20 and the skirt portion 10, the solution of the present invention requires that the front face 20*a* of the head portion 20 is coplanar to a plane containing the adjacent end edge 11 of the skirt portion 10 and that said head portion 20 is internal to the outer contour of said end edge 11 of the skirt portion 10, in which said head portion 20 is mounted.

In the constructions illustrated in FIGS. 1-13, in which the piston carries a suction valve 30, the front face 20*a* of the head portion 20 is coplanar to the plane which contains the adjacent end edge 11 of the skirt portion 10, so that a suction valve 30, to be described ahead, can be seated on the front face 20*a* of the head portion 20 and the end edge 11 of the skirt portion 10.

According to the present invention, in case a suction valve is provided in the piston, the mounting portion 22 preferably projects from the base body 21, in opposition to the front face 20*a* of the head portion 20 and towards the interior of the skirt portion 10, the base body 21 having its peripheral contour internal to an outer contour of the mounting portion 22, to guarantee a better gas flow in the suction through the head portion 20. It should be understood that the piston concept of the present invention also incorporates constructions in which the base body 21 has its peripheral contour coincident with the outer contour of the mounting portion 22, in which construction the suction is not made through the piston, as illustrated in FIGS. 1-13.

In accordance with a construction of the present invention, the mounting portion 22 comprises, incorporated to the base body 21, at least two body extensions 23, circumferentially spaced and defining, therebetween, respective suction openings 24 through the head portion 20, said body extensions 23 providing, in the mounting portion 22, a peripheral contour external to the head portion 20, and internal to which is positioned the outer peripheral contour of the base body 21.

In the construction illustrated in FIGS. 1-6 of the enclosed drawings, the base body 21 incorporates, in a single piece, three body extensions 23 radially projecting from the outer peripheral edge of said base body 21 and circumferentially and equally spaced from each other, said spacings providing, in the piston, the suction openings 24, upon mounting the head portion 20 to the skirt portion 10.

In another construction of the present invention, illustrated in FIGS. 7-13, the mounting portion 22 presents a continuous contour around the base body 21 of the head portion 20, defined by a peripheral ring 25 incorporated to said base body 21, said peripheral ring 25 seating on the circumferential and continuous recess 12 of the skirt portion 10, upon mounting the head portion 20 to the latter. In a constructive variant of this solution, the peripheral ring 25 of the mounting portion 22 is incorporated to the base body 21 by at least two body extensions 23, circumferentially spaced and defining, therebetween, respective suction openings 24 through the head portion 20, upon mounting it to the skirt portion 10. The at least two body extensions 23 extend axially away from the base body 21 and interconnect the peripheral ring 25 to the base body 21. Each of the body extensions 23 have an arcuate cross section so as to curve radially inward with respect to the base body 23. In the illustrated construction, the body extensions 23 radially axially project from the peripheral edge of the base body 21, defining a conical shape for the head portion 20. Also in this construction, the base body 21 has its peripheral edge internal to an outer contour of the mounting portion 22.

In the constructions illustrated in FIGS. 1-13, the base body 21 of the head portion 20 is provided with a central through hole 26 for the passage of a fixation means, such as a screw 40, which retains the suction valve 30 to the head portion 20, said suction valve 30 comprising valve portions in number and positioning corresponding to the suction openings 24 of the head portion 20 to be closed when the suction valve blocks the passage of fluid, when the compressor is not in the suction cycle. The screw 40 is dimensioned to slightly project from the plane containing the end edge 11 of the skirt portion 10 of the piston. At the end of the compression cycle of the piston, the screw is positioned in the interior of a recess, not illustrated, provided in the valve plate, from a face of the latter turned to the piston.

In some piston constructions, the base body 21 carries, in opposition to the front face 20*a*, a tubular projection 27 provided with a central channel 28, coaxially aligned with the central through hole 26 and open to the interior of the skirt portion 10, to receive an end of a piston rod, not illustrated.

Figure 14:
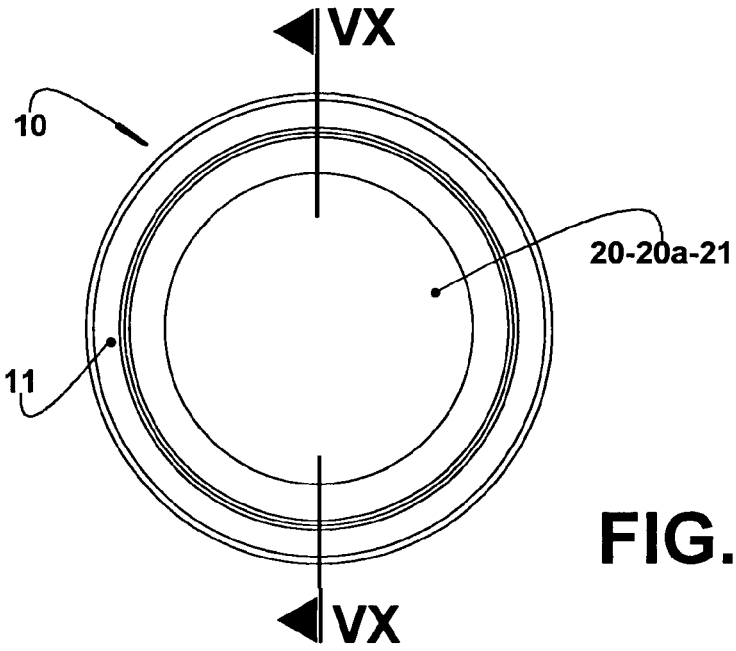
FIGS. 14 and 15 represent, schematically and respectively, views such as those of FIGS. 1 and 2, but illustrating a fourth piston construction of the present invention, but with the head portion deprived of a suction valve.
Figure 15:
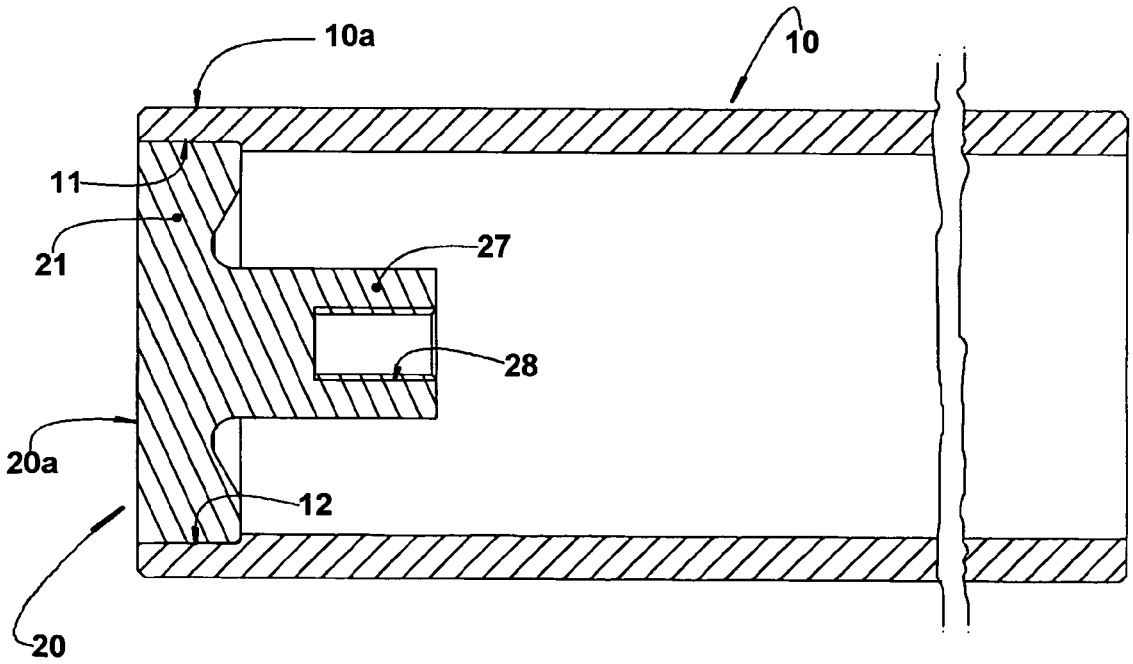

It should be further understood that, in the constructions in which the piston does not promote the passage of gas, through its body, during suction or discharge, its head portion 20 does not present suction openings, as illustrated in FIGS. 14 and 15. In this case, the base body 21 is mingled with the mounting portion 22, making the solid head portion 20 present a cylindrical shape fitted and affixed in the interior of the skirt portion 10, in a position seated on the recess 12, in case this is provided. In this case, the base body 21 carries, in opposition to the front face 20*a*, a tubular projection 27 provided with a central channel 28, open to the interior of the skirt portion 10, to receive an end of a piston rod, not illustrated.

The invention claimed is:

1. A piston for a refrigeration compressor, said piston comprising: a tubular skirt portion which is closed, next to an end edge, by a head portion, characterized in that said skirt portion is defined by a respective tube extension and presents an end edge region adjacent to said end edge and configured to affix said head portion formed in a separate piece, said head portion having a peripheral contour, internal to an axial projection of an outer contour of said skirt portion, said head portion presenting a base body in which it is defined a front face coplanar to a plane containing said end edge of said skirt portion, and a mounting portion incorporated to said base body, said mounting portion having a peripheral ring incorporated to said base body, and at least two body extensions extending axially away from said base body, said at least two body extensions interconnecting said peripheral ring to said base body so as to space said peripheral ring radially apart from said base body, said at least two body extensions circumferentially spaced apart from each other so as to define therebetween a respective suction openings through the head portion, said suction openings are selectively closed by a suction valve supported by said head portion, each of said at least two body extensions extending between said front face of said base body and said peripheral ring, said skirt portion having internally, at least one recess in its end region and said peripheral ring seating on the recess and mounted and affixed to said skirt portion.

2. The piston, as set forth in claim 1, wherein the recess occupies a certain circumferential extension of an inner contour of said end region of said skirt portion, defining a respective step, in relation to said inner contour, axially spaced back in relation to said end edge of the skirt portion.

3. The piston, as set forth in claim 2, wherein the recess is single and continuous and occupies the inner contour of the skirt portion.

4. The piston, as set forth in claim 1, wherein the skirt portion has an interior and the mounting portion projects from the base body, in opposition to the front face thereof and towards the interior of the skirt portion.

5. The piston, as set forth in claim 4, wherein the base body has a peripheral contour, internal to an outer contour of the mounting portion.

6. The piston, as set forth in claim 5, wherein the mounting portion presents a continuous contour around the base body.

7. The piston, as set forth in claim 1, wherein the recess is open to said end edge of the skirt portion.

8. The piston, as set forth in claim 1, characterized in that the head portion and the skirt portion are provided in different materials.

9. The piston, as set forth in claim 1, characterized in that each of said at least two body extensions having an arcuate cross section so as to curve radially inward with respect to said base body.

* * * * *